US011020302B2

(12) United States Patent
Gradov

(10) Patent No.: US 11,020,302 B2
(45) Date of Patent: Jun. 1, 2021

(54) CUSHIONED WATERLESS SANITARY TOILET

(71) Applicant: Natasha Gradov, Fort Lee, NJ (US)

(72) Inventor: Natasha Gradov, Fort Lee, NJ (US)

( * ) Notice: Subject to any disclaimer, the term of this patent is extended or adjusted under 35 U.S.C. 154(b) by 0 days.

(21) Appl. No.: 16/314,925

(22) PCT Filed: Aug. 12, 2016

(86) PCT No.: PCT/US2016/046786

§ 371 (c)(1),
(2) Date: Jan. 4, 2019

(87) PCT Pub. No.: WO2018/031034

PCT Pub. Date: Feb. 15, 2018

(65) Prior Publication Data

US 2019/0336372 A1 Nov. 7, 2019

(51) Int. Cl.
*A61G 9/00* (2006.01)

(52) U.S. Cl.
CPC ..... *A61G 9/003* (2013.01)

(58) Field of Classification Search
CPC ..... A61G 9/003
USPC ..... 4/450–457, 479, 486–487
See application file for complete search history.

(56) References Cited

U.S. PATENT DOCUMENTS 5,224,223 A * 7/1993 Royal ..... A61G 9/003 4/451
6,079,058 A * 6/2000 Green ..... A47K 11/045 4/479
6,449,782 B1 * 9/2002 Jones ..... A47K 11/02 4/451
2015/0182405 A1 * 7/2015 Gradov ..... A61G 9/003 4/452

* cited by examiner

*Primary Examiner* — Lori L Baker
(74) *Attorney, Agent, or Firm* — Mestechkin Law Group P.C.

(57) ABSTRACT

A toilet assembly includes a cushion defining a cushion niche and configured to be positioned under and support a backside of an individual. The toilet assembly also includes a waste collection receptacle having a receptacle body defining a sump configured to hold human waste. The waste collection receptacle is characterized by an external contour configured to selectively fit into the cushion niche and facilitate removal of the receptacle from the cushion niche when the cushion is positioned under the backside of the individual. The toilet assembly additionally includes a receptacle lid configured to be selectively opened to expose the sump and closed to hermetically seal the sump when the receptacle is positioned inside the cushion niche. A method of managing toiletry needs of an individual using the toilet assembly is also disclosed.

16 Claims, 5 Drawing Sheets

CUSHIONED WATERLESS SANITARY TOILET

TECHNICAL FIELD

The present disclosure is drawn to a cushioned waterless sanitary toilet for collection of human waste.

BACKGROUND

A toilet is a sanitation fixture used for the storing or disposal of human urine and feces. In developed countries fixed toilets are generally configured as seat or squat porcelain flush devices. In most urban areas such toilets are typically connected to a sewer system, while in less built-up areas toilets can be connected to septic tanks. In many developing countries, especially in rural areas, dry toilets such as pit latrines and composting toilets remain common. For convenience, some toilets can be movable or portable.

One of the most common types of portable toilets is a bedpan. A bedpan can be used for toileting of a bedridden patient in a health care facility. A typical bedpan is a rigid container that can be used for both urinary and fecal discharge. Generally, patients who cannot get out of bed easily, but who can control their bladder and bowels, are provided with a bedpan. The bedpan is generally placed underneath the patient, who can relieve him/herself as needed. Some patients may be able to place their own bedpans under themselves, in which case assistance is required only to empty the bedpan after its use.

SUMMARY

A toilet assembly includes a cushion defining a cushion niche and configured to be positioned under and support a backside of an individual. The toilet assembly also includes a waste collection receptacle having a receptacle body defining a sump configured to hold human waste. The waste collection receptacle is characterized by an external contour configured to selectively fit into the cushion niche and facilitate removal of the receptacle from the cushion niche when the cushion is positioned under the backside of the individual. The toilet assembly additionally includes a receptacle lid configured to be selectively opened to expose the sump and closed to hermetically seal the sump when the receptacle is positioned inside the cushion niche.

The cushion can define a U-shape, such as a general horseshoe shape, such that the cushion niche is defined by an interior of the U-shape. In such a case, the external contour of the receptacle body can be configured to fit into the interior of the U-shape, for example, the receptacle can be configured to slide into and out of the interior of the U-shape.

According to one embodiment of the disclosure, the receptacle body can include a lip. In such a case, the outer perimeter of the receptacle lid can include a channel configured to engage, for example, slide relative to, the receptacle body lip to thereby hermetically seal the sump.

According to another embodiment of the disclosure, the receptacle body can include a channel. In such a case, the outer perimeter of the receptacle lid can include a lip configured to engage, such as slide relative to, the receptacle body channel to thereby hermetically seal the sump.

The toilet assembly can also include a locking mechanism having a first feature on the receptacle body and a matching second feature on the receptacle lid configured to maintain closure between the receptacle body and the receptacle lid.

The receptacle body can have a receptacle body height. Additionally, the cushion can be inflated or filled with pellets, gel, etc. The cushion can also be defined by a first cushion height prior to inflation or being filled and a second cushion height following the inflation or the fill. Furthermore, the second cushion height can be greater than the receptacle body height to thereby preclude protrusion of the receptacle beyond the height of the cushion.

The receptacle body can include collapsible side-walls. Accordingly, the receptacle body height can be variable and configured to increase following the inflation of the cushion via an unfurling of the collapsible side-walls.

Each of the receptacle body and the receptacle lid can be constructed either from a plastic or a plastic-laminated paper material.

The toilet assembly can additionally include a cushion case constructed from a fluid-absorbent material. In such a case, the cushion can be arranged inside the cushion case. Furthermore, a portion of the cushion can then be arranged between the waste collection receptacle and the cushion and be configured to drape into the cushion niche as the receptacle body is fit therein.

The receptacle body can be either transparent or opaque. A completion of the individual's waste deposit into the sump can be verified through the transparent receptacle body prior to closing the receptacle lid.

A method of managing toiletry needs of an individual using the toilet assembly, as described above, is also disclosed.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

Figure 1:
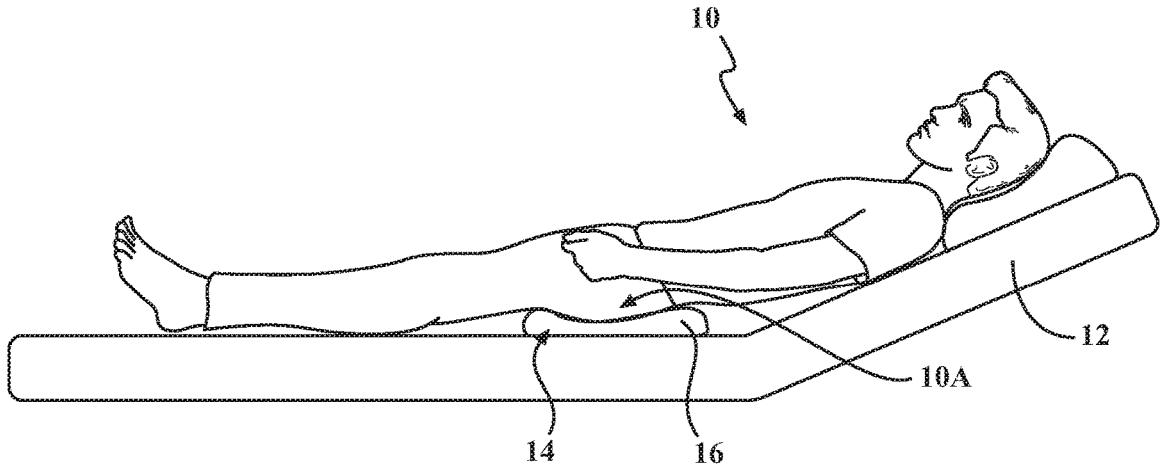
FIG. 1 is a schematic side view of an individual positioned on a bed and a toilet assembly situated therebetween, according to the disclosure.

Referring to the drawings, wherein like reference numbers refer to like components, FIG. 1 shows an individual 10, such as a dependent patient, situated on a bed 12, and a toilet assembly 14 according to the disclosure arranged between the bed and the individual's backside 104 and used as a bedpan assembly. The toilet assembly 14 is specifically configured as a cushioned, waterless sanitary toilet. As will be detailed in the present disclosure, the toilet assembly 14 is configured to provide a sanitary, private, and odor-dispersion limiting solution to toileting of the individual 10. Moreover, in medical facilities, the disclosed toilet assembly 14 can be used to reduce the spread of airborne bacteria and viruses that may be the cause of various infections. Accordingly, the toilet assembly 14 can be effective in countering drug-resistant infections. Although the remainder of the present disclosure concentrates on using the toilet assembly 14 for the individual 10 situated in the bed 12, nothing precludes the toilet assembly from being used by a seated or elsewise positioned individual for meeting his/her toileting needs.

In health care, toileting is the act of assisting a dependent patient with his/her waste elimination needs. Depending on a patient's condition, his/her toileting needs may need to be met differently. Sometimes, the patient can be assisted to walk to a toilet, while in other situations the patient may be confined to a bed and may have to be provided with a bedpan. Although some diseases can permanently confine a patient to bed, necessitating routine reliance on a bedpan, many patients may be confined to a bed as a result of a temporary illness, injury, or surgery, thereby necessitating short-term bedpan use. Typically, a bedpan is placed underneath a patient situated in a bed either by the patient or by an assistant, e.g., a nurse. If the patient is able to position his/her own bedpan, assistance is then required only to empty the bedpan. Accordingly, use of the toilet assembly 14 according to the present disclosure can be facilitated by either the individual 10 him/herself or by an assistant.

Figure 2:
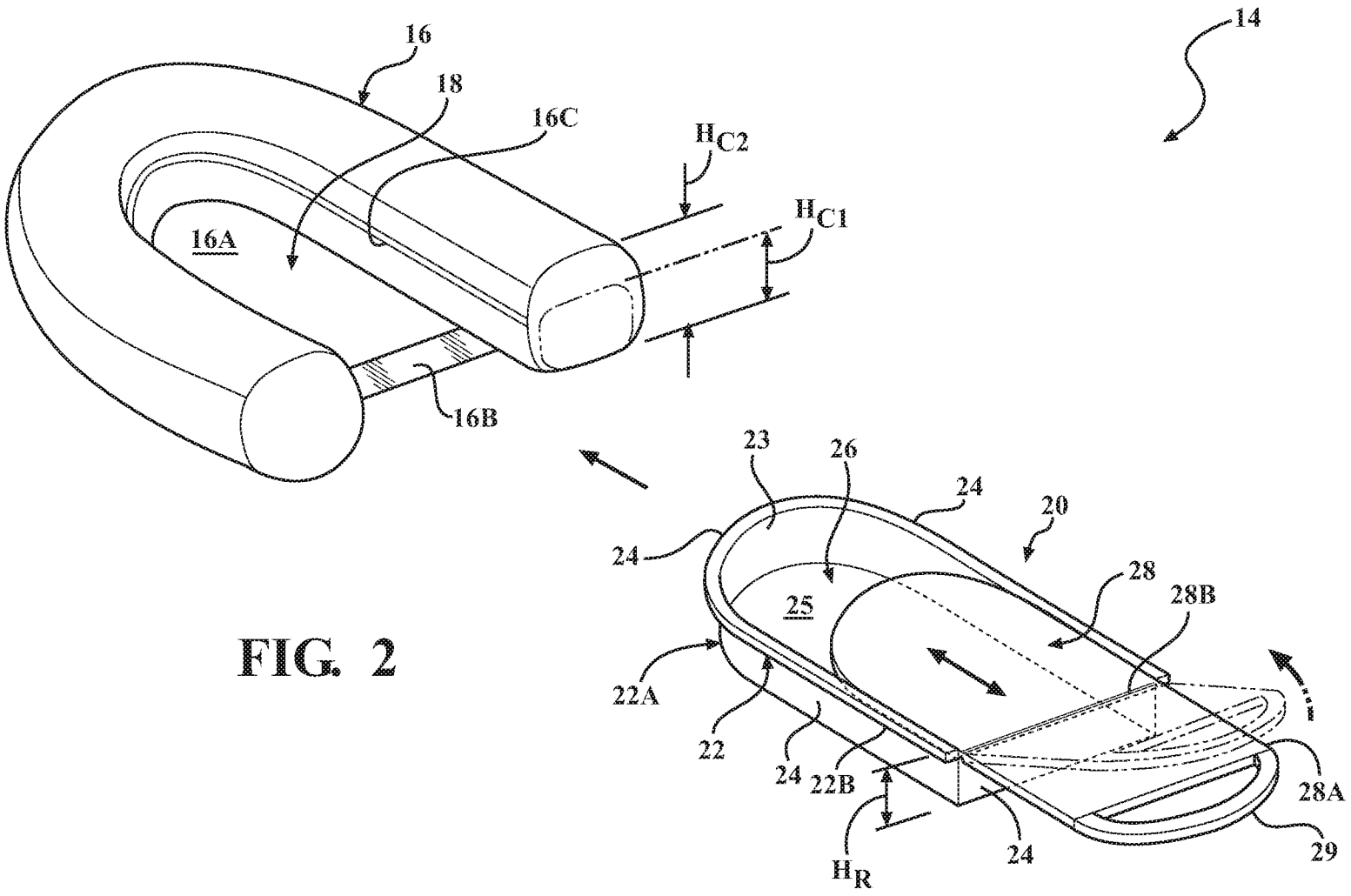
FIG. 2 is a schematic close-up exploded perspective view of the toilet assembly shown in FIG. 1, having a cushion defining a cushion niche, and a receptacle, including a receptacle lid and a receptacle body, configured to be arranged within the cushion niche, according to the disclosure.

The toilet assembly 14 includes a toilet cushion 16. The cushion 16 is configured as a relatively compliant pad or a base of the toilet assembly 14. As shown, the cushion 16 is configured to be positioned on the bed 12 and under the individual 10 to comfortably and resiliently support and accommodate the individual's backside 10A. FIG. 2 depicts a close-up view of the toilet assembly 14. As shown in FIG. 2, the cushion 16 defines a cushion niche 18. The cushion niche 18 can be configured as a depression or recess in the cushion 16 (not shown), or as an aperture extending through the cushion, as shown in FIG. 2. The cushion 16 can be configured as an inflatable structure, such as with air or another gas, or be filled with a liquid, pellets, gel, etc.

The toilet assembly 14 also includes a waste collection receptacle 20. The receptacle 20 includes a receptacle body 22. The receptacle body 22 includes an open top portion 23, as well as four side-walls 24 and a bottom surface 25 that together define a sump 26 configured to capture and hold biological or human waste. The receptacle body 22 is characterized by an external contour 22A. The external contour 22A of the receptacle body 22 is configured to selectively fit into the cushion niche 18. Additionally, the external contour 22A of the receptacle body 22 can be configured to facilitate removal of the receptacle 20 from the cushion niche 18 when the cushion 16 is positioned under the backside 10A of the individual 10. Such capability of the assembly and disassembly of the receptacle 20 and the cushion 16 can be accomplished via cooperating features of the subject components. For example, the cushion 16 can define an aperture in one of its sides to permit removal of the receptacle 20 therethrough.

The toilet cushion 16 can have an open-ended rectangular, open-ended triangular, a semi-circular or other similarly open-ended construction. Alternatively, the cushion 16 can have a substantially closed ended-shape, but one defining a ramp or channel leading to the cushion niche 18 for accommodating the waste collection receptacle 20. In other words, the cross-section of the cushion 16 is intended to have any shape suitable to accommodate the backside 10A of the individual, and also provide a resting position and an access thereto for the collection receptacle 20. The cushion 16 can have a single or a multi-section construction and be fabricated from a durable, fluid-proof, and hypoallergenic material. The selected material can be employed to generate an inflatable cushion 16 structure capable of withstanding at least 4 Psi of internal pressure. For example, the cushion 16 can be constructed from a 200D TPU-coated woven nylon fabric.

In a specific embodiment of the toilet assembly 14 construction, the cushion 16 can define a U-shape, i.e., a general horseshoe shape, and may also have a tubular structure in a cross-sectional view. The cushion niche 18 can be defined by the interior of the U-shape, i.e., by a space 16A between the legs of the U-shape. The base between the legs of the U-shape may have any curvature or have a generally rectangular shape. As shown in FIG. 2, the legs of the U-shape can be connected by a bridge 16B that can also serve to support the receptacle body 22 when the receptacle 20 is positioned inside the cushion niche 18. In such an embodiment, the external contour 22A of the receptacle body 22 can be shaped to substantially match the U-shape of the cushion niche 18. In other words, the external contour 22A can be configured to fit into the interior of the U-shape defined by the space 16A, such that the receptacle can be slid into and out of the interior of the U-shape while the cushion 16 remains under the individual 10. Additionally, the cushion 16 can include rails 16C or other suitable protrusions extending substantially around the cushion niche 18 and configured to engage a rim or ridge 22B surrounding the external contour 22A of the receptacle body 22 for support thereof.

A piece of fluid-absorbent material can be placed into the sump 26, i.e., on the bottom of the receptacle body 22, to soak up the individual's fluid discharge. An appropriate fluid-absorbent material for the task can be a super-absorbent polymer (SAP), for example sodium polyacrylate, which is a sodium salt of polyacrylic acid with the chemical formula $[—CH2\text{-}CH(CO2Na)\text{-}]_n$. Typically, such SAPs have the ability to absorb as much as 200 to 300 times their mass in water, and would, therefore, permit a largely spill-proof collection of waste discharge from the individual 10 via the toilet assembly 14.

Figure 4:
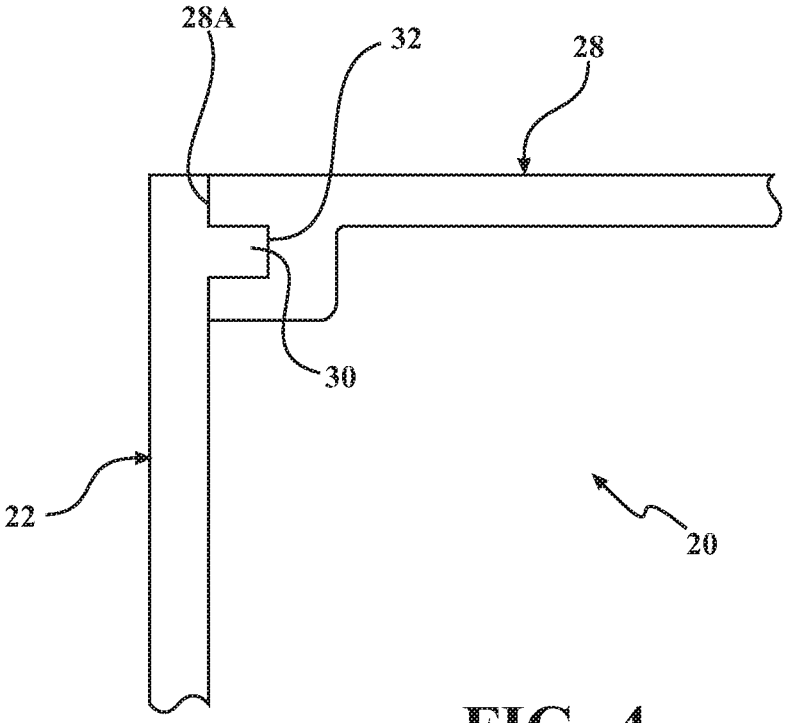
FIG. 4 is a schematic close-up view of another embodiment of the receptacle, according to the disclosure.
Figure 5:
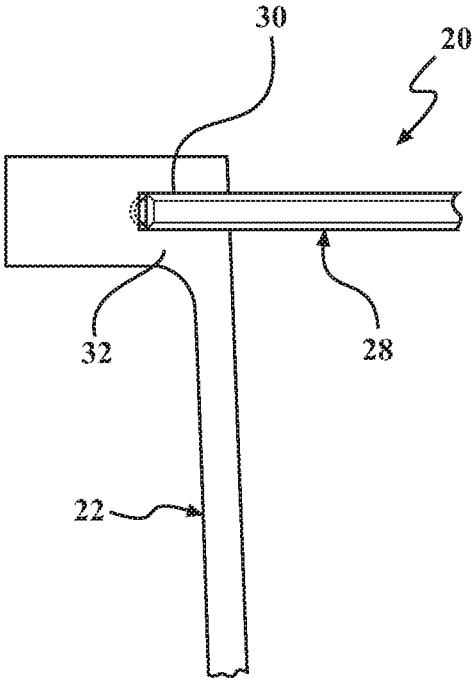
FIG. 5 is a schematic close-up view of yet another embodiment of the receptacle, according to the disclosure.

As shown in FIGS. 2, 4, and 5, the receptacle 20 also includes a receptacle lid 28 configured to be moveably engaged with the receptacle body 22 at the open top portion 23. The lid 28 is additionally configured to be selectively opened to expose the sump 26 and closed to hermetically seal, i.e., generate an airtight seal with, the sump when the receptacle 20 is positioned inside the cushion niche 18. The lid 28 and the receptacle body 22 can be configured to cooperate, such that the lid can be slid, snapped, or rolled on and off the receptacle body. As such, the toilet assembly 14 is specifically configured with sufficient access to the lid 28 to permit the receptacle 20 to be selectively opened and closed even while the receptacle remains situated inside the cushion niche 18 and under the individual 10, thus preventing exposure of the biological waste, spills, and spread of infection. Naturally, the lid 28 can be detached from the receptacle body 22 when the receptacle 20 is removed from the cushion niche 18, and thus is apart from the cushion 16, so that, for example, the receptacle can be opened and the deposited waste can be used for clinical analysis. To facilitate operation, i.e., selective opening and closing, of the receptacle 20, the lid 28 can include a handle 29 configured to be grasped either by the individual 10 or by the individual's assistant. Following the waste having been deposited into the waste collection receptacle 20, the lid 28 can be closed and the entire receptacle can be discarded, as deemed appropriate. The hermetically sealed receptacle 20 can be used for safe disposal of human waste, vomit, and blood. Such sealed disposal of various substances, including biohazardous waste, can be beneficial in protecting a caregiver from exposure to infections and reducing the possibility of contaminating the surrounding environment.

Figure 3:
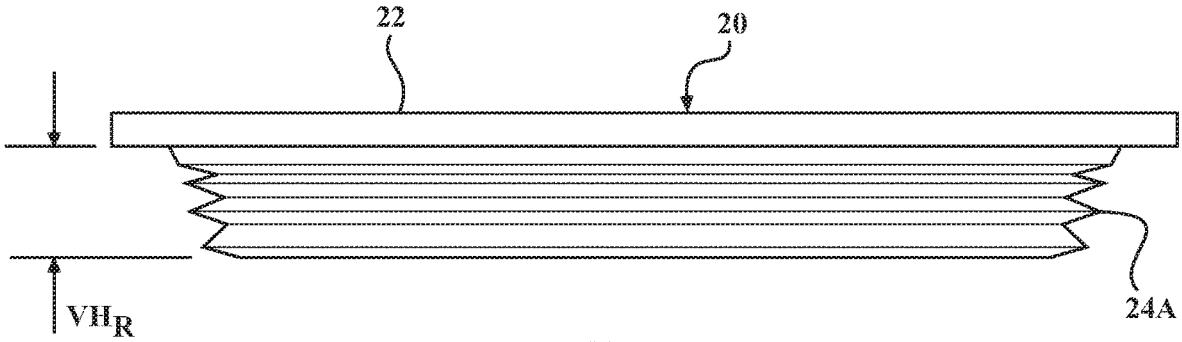
FIG. 3 is a schematic close-up side view of one embodiment of the receptacle, according to the disclosure.

The receptacle body 22 has a receptacle body height $H_R$. In the embodiment of the toilet assembly 14 having an inflatable cushion 16, the cushion is defined by a first cushion height $H_{C1}$ prior to inflation and a second cushion height $H_{C2}$ following the inflation (shown in FIG. 2). In such a construction, the second cushion height $H_{C2}$ can be selected such that the second cushion height is greater than the receptacle body height $H_R$ to minimize the possibility of the receptacle extending beyond, i.e., protruding above, the second cushion height when the toilet assembly 14 is situated under the individual's backside 10A. As shown in FIG. 3, the receptacle body 22 can have collapsible side-walls 24A. The collapsible side-walls 24A provide the receptacle body 22 with a variable body height $VH_R$. The variable receptacle body height $VH_R$ is configured to increase following the inflation of the cushion 16 via an unfurling of the collapsible side-walls 24A. Accordingly, a volume of the sump 26 defined by the collapsible side-walls 24A is similarly variable. Specifically, the collapsible side-walls 24A can be formed to fold or accordion onto themselves, such as by using bellows, as shown.

Each of the receptacle body 22 and the receptacle lid 28 can be constructed from a material that is sufficiently robust to withstand handling by either the individual 10 or the individual's assistant, as well as for impermeability to fluids. Furthermore, the receptacle lid 28 and the receptacle body 22 can be manufactured either from the same material or from different materials, as desired. Such a material can, for example, be any thermoset or thermoplastic polymer, a closed-cell extruded polystyrene foam, paperboard, or a plastic-laminated paper material, wherein the plastic lamination layer would be positioned on the respective interior surfaces of each of the receptacle body 22 and the receptacle lid 28 that could come into contact with waste discharge from the individual 10. The lid 28 can be constructed from a more flexible material than the receptacle body 22, such that the lid can be snapped onto the receptacle body without inducing closure-preventing deformation thereof. Additionally, the receptacle body 22, and specifically the side-walls 24 or 24A, can be either transparent or opaque. For example, a transparent receptacle body 22 can be used by the individual's assistant to verify completion of the deposit of the individual's waste into the sump 26 prior to closing the receptacle lid 28 and removing the receptacle 20 or the entire toilet assembly 14 from under the individual's backside 10A. Additionally, the transparent receptacle body 22 can facilitate assessment of the patient's waste sample either before or prior to closing the receptacle 20, for example identifying presence of blood or other indicators of health issues requiring immediate response. Such a transparent receptacle body 22 can also include a measuring scale incorporated, such as molded, into any of the side-walls 24 for medical purposes.

Once the individual 10 has deposited the waste into the receptacle 20, it is useful for the waste to be handled in a sanitary manner that also limits dispersion of waste odor. To such an end, in a specific embodiment shown in FIG. 4, the receptacle body 22 can include a lip 30. The lip 30 can be arranged near the open top portion 23 and extend substantially around three of the four side-walls 24 or 24A. The receptacle lid 28 is defined by an outer perimeter 28A (shown in FIG. 2). In the present embodiment, the outer perimeter 28A of the receptacle lid 28 includes a complementary channel 32 arranged around three sides of the lid that come into direct contact with the receptacle 20. The channel 32 on the receptacle lid 28 is configured to engage and slide relative to the receptacle body lip 30 to thereby hermetically seal the sump 26. Alternatively, as shown in FIG. 5, the outer perimeter of the receptacle lid 28 can include the lip 30, while the receptacle body 22 can include the channel 32. In such an embodiment, the lip 30, being part of the receptacle lid 28, is configured to slide relative to and engage the receptacle body channel 32 to thereby hermetically seal the sump 26.

Alternatively, although not shown, the receptacle lid 28 and the receptacle body 22 can include interacting features facilitating a snap on and off action of the lid onto the receptacle body. Either part of the snap on/off embodiment of the receptacle lid 28 and the receptacle body 22 or in a separate embodiment, the receptacle lid can be connected to the receptacle body via a living hinge (not shown), thereby providing a permanent connection therebetween. Furthermore, in addition to such a living hinge, a tether connection (not shown) can extend between the receptacle lid 28 and the receptacle body 22 to establish a fully open position of the receptacle lid relative to the receptacle body. In such an embodiment, when the toilet assembly 14 is positioned under the backside 10A of the individual 10 and the sump 26 is exposed, the combination of the living hinge and the tether connection can facilitate the receptacle lid being employed as a waste discharge deflector. Each of the tether connection and the living hinge can be constructed from the same material as the receptacle lid 28 and/or the receptacle body 22. The receptacle lid 28 can additionally include a living hinge 28B positioned to permit a portion of the receptacle lid that is not engaged with the receptacle body 22 to be bent or folded upward. The bent-up portion of the lid 28 at the living hinge 28B can be positioned to operate as a splash guard when the sump 26 is open.

Figure 6:
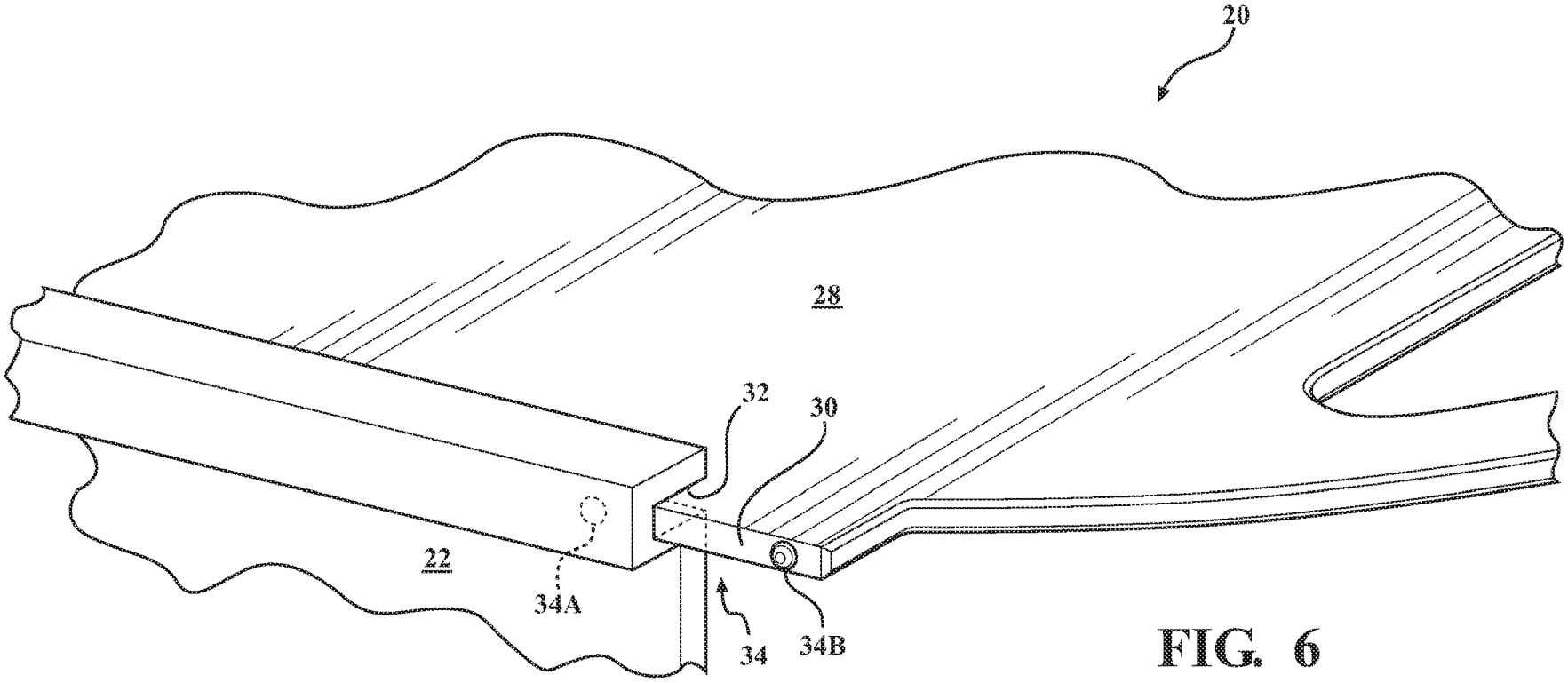
FIG. 6 is a schematic close-up view of a locking mechanism configured to maintain engagement between the receptacle lid and the receptacle body in the toilet assembly, according to the disclosure.

As shown in FIG. 6, the toilet assembly 14 can additionally include a locking mechanism 34 configured to ensure maintained engagement between the receptacle lid 28 and the receptacle body 22 once the lid has been closed. The locking mechanism 34 can include at least one first feature 34A arranged on the receptacle body 22 and a matching at least one second feature 34B arranged on the receptacle lid 28. Such first and second features 34A, 34B, upon engagement therebetween, are configured to maintain closure of the receptacle lid relative to the receptacle body. Specifically, the first feature 34A can be one or more projections, while the second feature 34B can be matching dimple(s) or depression(s) configured to capture the projection(s). The toilet assembly 14 can include any number of each of the first feature 34A and the matching second feature 34B as deemed necessary for maintaining positive and reliable closure of the receptacle lid 28 with respect to the receptacle body 22.

Although not shown, the shape and configuration of the first and second features 34A, 34B can also be switched, such that the receptacle lid 28 includes projection(s) and the receptacle body 22 includes matching depression(s). Generally, however, the first feature 34A and the matching second feature 34B are contemplated as cooperating features that permit maintaining a secure closure between the receptacle body 22 and the receptacle lid 28. Alternatively, the locking mechanism 34 can be configured as an adhesive surface on either the receptacle body 22 or the receptacle lid 28. For example, such an adhesive surface can be provided by a self-stick tape affixed to either the receptacle body 22 or to the receptacle lid 28, for contact and adherence to the other of the two parts via light pressure.

Figure 7:
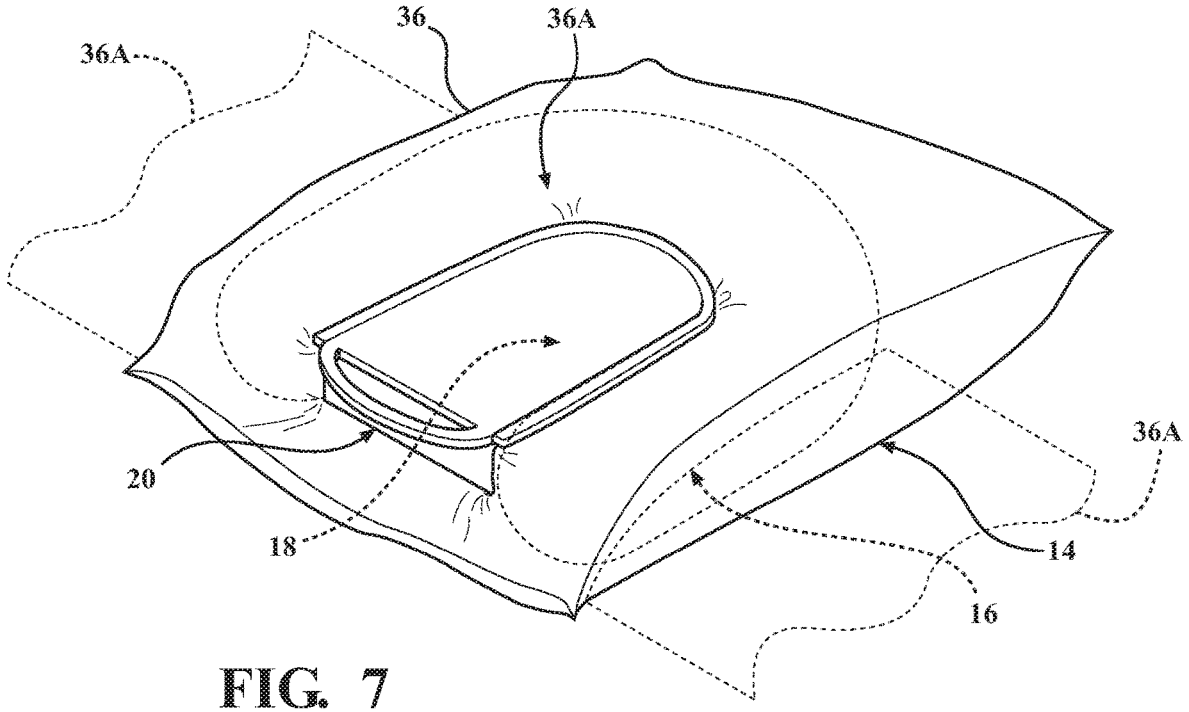
FIG. 7 is a schematic close-up view of the toilet assembly including a cushion case, according to the disclosure.

As shown in FIG. 7, the toilet assembly 14 can additionally include a cushion case 36. The cushion case 36 can be constructed from a fluid-absorbent material, such as a thermally-bonded non-woven synthetic fiber and cellulose blend fabric having a plastic film or backing to inhibit seepage of fluids through the case. In such an embodiment, the cushion 16 is intended to be arranged inside the cushion case 36. As shown, once the waste collection receptacle 20 has been placed into the cushion niche 18 over the cushion case 36, a portion 36A of the cushion case will become arranged between the receptacle and the cushion 16. Accordingly, the portion 36A of the cushion case 36 is configured to drape into the cushion niche 18 as the receptacle body 22 is fit therein. Such an embodiment of the toilet assembly 14 permits the cushion case 36 to absorb any possible splatter from the waste being deposited into the waste collection receptacle 20. Also, as shown in FIG. 7, the cushion case 36 can include material sections 36A extending therefrom, which can be used to cover the individual's legs and shield them from the splatter. The cushion case 36 can subsequently be washed, disinfected, or disposed of, as deemed appropriate. Additionally, in the event there is any damage to the receptacle 20, the cushion case 36 can provide a secondary layer of sanitary, odor, and anti-spill protection as the receptacle with biological waste is placed inside the cushion case 36 for disposal.

Figure 8:
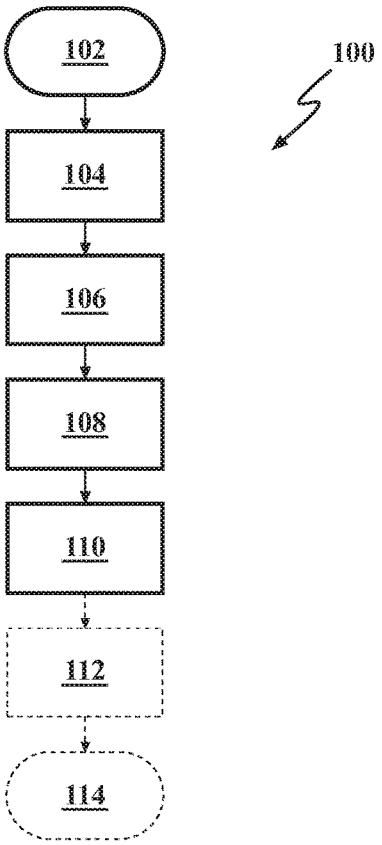
FIG. 8 is a flow diagram of a method of managing toiletry needs of the individual using the toilet assembly shown in FIGS. 1-7.

FIG. 8 depicts a method 100 of managing or tending to toiletry or waste elimination needs of the individual 10 (such as shown in FIG. 1) in a waterless, sanitary, and odor-dispersion limiting manner. The method 100 operates in accordance with the above disclosure with respect to FIGS. 1-7. The method 100 commences in frame 102 where the method includes providing the toilet assembly 14 for the toiletry needs of the individual 10. In frame 102 the method can also include fitting the receptacle body 22 into the interior of the U-shape of the cushion 16, as defined by the space 16A between the legs of the U-shape. As described above, the toilet assembly 14 can additionally include the cushion case 36 constructed from a fluid-absorbent material. In frame 102 the method can also include arranging the cushion 16 inside the cushion case 36 and arranging the portion 36A of the cushion case between the waste collection receptacle 20 and the cushion, such that the portion 36A drapes into the cushion niche 18 as the receptacle body is fit therein.

Following frame 102 the method advances to frame 104. In frame 104 the method includes positioning the toilet assembly 14 under the backside 10A of the individual 10. As part of frame 104, the method may include inflating the cushion 16 either prior to or subsequent to inserting the cushion under the backside 10A of the individual 10. As described above with respect to FIG. 2, the cushion 16 can be inflatable, wherein the cushion is defined by a first cushion height $H_{C1}$ prior to inflation and a second cushion height $H_{C2}$ following the inflation. Such an inflatable cushion 16 can be paired with the receptacle body 22 having collapsible side-walls 24A that provide the receptacle body with the variable body height $VH_R$. In such an embodiment, as part of frame 104, the positioning of the toilet assembly 14 may also include increasing the receptacle body height $VH_R$ via unfurling of the collapsible side-walls 24A after the inflation of the cushion 16.

From frame 104 the method proceeds to frame 106. In frame 106 the method includes opening the receptacle lid 28 to expose the sump 26. After frame 106 the method moves on to frame 108. In frame 108 the method includes waiting until the individual 10 has completed his/her toiletry needs, i.e., deposited the individual's waste into the exposed sump 26. Such waiting for the individual 10 to complete his/her toiletry needs may include verifying completion of the individual's waste deposit into the exposed sump 26 through the transparent receptacle body 22, for example thorough transparent side-walls 24 or 24A.

Following frame 108 the method advances to frame 110. In frame 110 the method includes closing the receptacle lid 28 to hermetically seal the sump 26 following the completion of the deposit of the individual's waste into the exposed sump. As discussed above regarding the respective FIGS. 4 and 5, the receptacle body 22 can include the lip 30, while the outer perimeter of the receptacle lid 28 can include the channel 32, or, conversely, the outer perimeter of the receptacle lid 28 can include the lip 30, while the receptacle body 22 can include the channel 32. In such embodiments, the act of closing the receptacle lid 28 can include engaging the lip 30 with the channel 32 by sliding the lid relative to the receptacle body 22 to thereby hermetically seal the sump 26.

As part of frame 110, the method may include maintaining closure between the receptacle lid 28 and the receptacle body 22 via the locking mechanism 34 having the first feature 34A on the receptacle body and a matching second feature 34B on the receptacle lid. As describe above, the locking mechanism 34 can also be configured as a stick-on feature, such as self-stick tape affixed to either on the receptacle body 22 or to the receptacle lid 28. After frame 110, i.e., following the closing of the receptacle lid 28, the method may proceed to frame 112. In frame 112 the method can include removing the toilet assembly 14 from under the individual's backside 10A and removing the receptacle body 22 from the cushion niche 18. The act of removing the receptacle body 22 from the cushion niche 18 can specifically include removing the receptacle body from the interior of the cushion 16 U-shape.

The method 100 can be practiced by either the individual 10 him/herself or by an assistant of the individual. Accordingly, the method 100 can employ the toilet assembly 14 as a bedpan or, generally, as a portable toilet. Furthermore, the method 100 can be used by the individual 10 situated in the bed 12, in a seated, or in a squat position for meeting his/her toileting needs. The method 100 may be completed in frame 114 via disposing of or discarding the receptacle 20. Such disposing of the receptacle 20 can include placing and/or wrapping the receptacle inside the cushion case 36 for disposal therewith. Overall, the method 100 provides an individual 10 with the capability to meet his/her toileting needs in a waterless, private, sanitary, and odor-dispersion limiting manner. When employed in medical facilities, the method 100 can be useful in reducing the spread of airborne bacteria and viruses that may be the cause of various infections.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A waterless sanitary toilet assembly comprising:

a cushion defining a cushion niche and configured to be positioned under and support a backside of an individual; and a waste collection receptacle comprising:

a receptacle body defining a sump configured to hold human waste, characterized by an external contour configured to selectively fit into the cushion niche and facilitate removal of the receptacle from the cushion niche when the cushion is positioned under the backside of the individual; and a receptacle lid configured to be selectively opened to expose the sump and closed to hermetically seal the sump, wherein, the receptacle body includes a lip and wherein an outer perimeter of the receptacle lid includes a channel configured to engage the lip to thereby hermetically seal the sump.

2. The toilet assembly according to claim 1, wherein: the cushion defines a U-shape and the cushion niche is defined by the interior of the U-shape; and the external contour of the receptacle body is configured to fit into the interior of the U-shape.

3. The toilet assembly according to claim 1, wherein the receptacle body is one of transparent and opaque.

4. A waterless sanitary toilet assembly comprising:

a cushion defining a cushion niche and configured to be positioned under and support a backside of an individual; and a waste collection receptacle comprising:

a receptacle body defining a sump configured to hold human waste, characterized by an external contour configured to selectively fit into the cushion niche and facilitate removal of the receptacle from the cushion niche when the cushion is positioned under the backside of the individual; and a receptacle lid configured to be selectively opened to expose the sump and closed to hermetically seal the sump, wherein, the receptacle body includes a channel and wherein an outer perimeter of the receptacle lid includes a lip configured to engage the channel to thereby hermetically seal the sump.

5. A waterless sanitary toilet assembly comprising:

a cushion defining a cushion niche and configured to be positioned under and support a backside of an individual; and a waste collection receptacle comprising:

a receptacle body defining a sump configured to hold human waste, characterized by an external contour configured to selectively fit into the cushion niche and facilitate removal of the receptacle from the cushion niche when the cushion is positioned under the backside of the individual;

a receptacle lid configured to be selectively opened to expose the sump and closed to hermetically seal the sump; and a locking mechanism having a first feature on the receptacle body and a matching second feature on the receptacle lid configured to maintain closure between the receptacle body and the receptacle lid.

6. A waterless sanitary toilet assembly comprising:

a cushion configured to be inflated and defining a cushion niche and configured to be positioned under and support a backside of an individual, wherein the cushion is defined by a first cushion height prior to inflation and a second cushion height following the inflation; and a waste collection receptacle comprising:

a receptacle body defining a sump configured to hold human waste, characterized by an external contour configured to selectively fit into the cushion niche and facilitate removal of the receptacle from the cushion niche when the cushion is positioned under the backside of the individual, wherein the receptacle body has a receptacle body height wherein the second cushion height is greater than the receptacle body height; and a receptacle lid configured to be selectively opened to expose the sump and closed to hermetically seal the sump, wherein the receptacle body includes collapsible side-walls, and wherein the receptacle body height is configured to increase following the inflation of the cushion via an unfurling of the collapsible side-walls.

7. The toilet assembly according to claim 6, wherein each of the receptacle body and the receptacle lid is constructed from one of a plastic and a plastic-laminated paper material.

8. A waterless sanitary toilet assembly comprising:

a cushion defining a cushion niche and configured to be positioned under and support a backside of an individual;

a cushion case constructed from a fluid-absorbent material, wherein the cushion is arranged inside the cushion case, wherein a portion of the cushion case is arranged between the waste collection receptacle and the cushion, and wherein the cushion base is configured to drape into the cushion niche as the receptacle body is fit therein; and a waste collection receptacle comprising:

a receptacle body defining a sump configured to hold human waste, characterized by an external contour configured to selectively fit into the cushion niche and facilitate removal of the receptacle from the cushion niche when the cushion is positioned under the backside of the individual; and a receptacle lid configured to be selectively opened to expose the sump and closed to hermetically seal the sump.

9. A method of managing toiletry needs of an individual, comprising:

positioning a waterless sanitary toilet assembly under the backside of the individual, wherein the toilet assembly includes:

a cushion configured to support the backside of the individual and defining a cushion niche; and a waste collection receptacle including: a receptacle body defining a sump, characterized by an external contour configured to selectively fit into the cushion niche and facilitate removal of the receptacle from the cushion niche when the cushion is positioned under a backside of the individual, wherein the receptacle body includes a lip and the outer perimeter of the receptacle lid includes a channel, and wherein said closing the receptacle lid includes engaging the receptacle body lip with the channel to thereby hermetically seal the sump; and a receptacle lid configured to be selectively opened to expose the sump and closed to hermetically seal the sump when the receptacle is positioned inside the cushion niche;

opening the receptacle lid to expose the sump;

waiting for a completion of a deposit of the individual's waste into the exposed sump; and closing the receptacle lid to hermetically seal the sump following the completion of the deposit of the individual's waste into the exposed sump.

10. The method of managing toiletry needs according to claim 9, further comprising: removing the toilet assembly from under the individual's backside following said closing the receptacle lid; removing the receptacle body from the cushion niche; and disposing of the receptacle.

11. The method of managing toiletry needs according to claim 10, wherein the cushion defines a U-shape and the cushion niche is defined by the interior of the U-shape, and wherein: said providing the toilet assembly includes fitting the receptacle body into the interior of the U-shape; and said removing the receptacle body from the cushion niche includes removing the receptacle body from the interior of the U-shape.

12. The method of managing toiletry needs according to claim 9, wherein the receptacle body is transparent, and wherein the method further comprising verifying said completion of the deposit of the individual's waste into the exposed sump through the transparent receptacle body prior to said closing the receptacle lid.

13. A method of managing toiletry needs of an individual, comprising:

positioning a waterless sanitary toilet assembly under the backside of the individual, wherein the toilet assembly includes:

a cushion configured to support the backside of the individual and defining a cushion niche; and a waste collection receptacle including:

a receptacle body defining a sump, characterized by an external contour configured to selectively fit into the cushion niche and facilitate removal of the receptacle from the cushion niche when the cushion is positioned under a backside of the individual, wherein the receptacle body includes a channel and the outer perimeter of the receptacle lid includes a lip, and wherein said closing the receptacle lid includes engaging the lip with the receptacle body channel to thereby hermetically seal the sump;

and a receptacle lid configured to be selectively opened to expose the sump and closed to hermetically seal the sump when the receptacle is positioned inside the cushion niche; and opening the receptacle lid to expose the sump; waiting for a completion of a deposit of the individual's waste into the exposed sump; and closing the receptacle lid to hermetically seal the sump following the completion of the deposit of the individual's waste into the exposed sump.

14. A method of managing toiletry needs of an individual, comprising:

positioning a waterless sanitary toilet assembly under the backside of the individual, wherein the toilet assembly includes:

a cushion configured to support the backside of the individual and defining a cushion niche; and a waste collection receptacle including:

a receptacle body defining a sump, characterized by an external contour configured to selectively fit into the cushion niche and facilitate removal of the receptacle from the cushion niche when the cushion is positioned under a backside of the individual; and a receptacle lid configured to be selectively opened to expose the sump and closed to hermetically seal the sump when the receptacle is positioned inside the cushion niche;

opening the receptacle lid to expose the sump;

waiting for a completion of a deposit of the individual's waste into the exposed sump; and closing the receptacle lid to hermetically seal the sump following the completion of the deposit of the individual's waste into the exposed sump; and maintaining closure between the receptacle lid and the receptacle body via a locking mechanism including a first feature on the receptacle body and a matching second feature on the receptacle lid.

15. A method of managing toiletry needs of an individual, comprising:

positioning a waterless sanitary toilet assembly under the backside of the individual, wherein the toilet assembly includes:

a cushion configured to support the backside of the individual and defining a cushion niche; and a waste collection receptacle including:

a receptacle body defining a sump, characterized by an external contour configured to selectively fit into the cushion niche and facilitate removal of the receptacle from the cushion niche when the cushion is positioned under a backside of the individual, wherein the receptacle body includes collapsible side-walls and wherein said positioning the toilet assembly under the backside of the individual includes increasing the receptacle body height via unfurling the collapsible side-walls following said inflating the cushion; and a receptacle lid configured to be selectively opened to expose the sump and closed to hermetically seal the sump when the receptacle is positioned inside the cushion niche, wherein said positioning the toilet assembly under the backside of the individual includes inflating the cushion, wherein the receptacle body has a receptacle body height and the cushion is defined by a first cushion height prior to inflation and a second cushion height following the inflation, and wherein the second cushion height is greater than the receptacle body height;

opening the receptacle lid to expose the sump, waiting for a completion of a deposit of the individual's waste into the exposed sump; and closing the receptacle lid to hermetically seal the sump following the completion of the deposit of the individual's waste into the exposed sump.

16. A method of managing toiletry needs of an individual, comprising:

positioning a waterless sanitary toilet assembly under the backside of the individual, wherein the toilet assembly includes:

a cushion configured to support the backside of the individual and defining a cushion niche; and a waste collection receptacle including:

a receptacle body defining a sump, characterized by an external contour configured to selectively fit into the cushion niche and facilitate removal of the receptacle from the cushion niche when the cushion is positioned under a backside of the individual; and a receptacle lid configured to be selectively opened to expose the sump and closed to hermetically seal the sump when the receptacle is positioned inside the cushion niche; and a cushion case constructed from a fluid-absorbent material;

prior to said positioning the toilet assembly under the backside of the individual, arranging the cushion inside the cushion case and arranging a portion of the cushion case between the waste collection receptacle and the cushion to thereby drape the portion of the cushion case into the cushion niche as the receptacle body is fit therein;

opening the receptacle lid to expose the sump;

waiting for a completion of a deposit of the individual's waste into the exposed sump; and closing the receptacle lid to hermetically seal the sump following the completion of the deposit of the individual's waste into the exposed sump.

* * * * *